US006178794B1

(12) United States Patent
Eller et al.

(10) Patent No.: US 6,178,794 B1
(45) **Date of Patent: *Jan. 30, 2001**

(54) LEVER HANDLE CONTROLLER

(75) Inventors: Darren C. Eller, East Lyme; Richard Hai Huang, New Haven; Thomas A. Pelletier, Wallingford, all of CT (US)

(73) Assignee: Sargent Manufacturing Company, New Haven, CT (US)

( * ) Notice: Under 35 U.S.C. 154(b), the term of this patent shall be extended for 0 days.

This patent is subject to a terminal disclaimer.

(21) Appl. No.: 09/232,410

(22) Filed: Jan. 15, 1999

(51) Int. Cl.[7] ..... E05B 55/04
(52) U.S. Cl. ..... 70/472; 70/149; 292/DIG. 27
(58) Field of Search ..... 292/DIG. 27, 169.21, 292/169.22, 169.23; 70/149, 472, 118

(56) References Cited

U.S. PATENT DOCUMENTS

| | | | | |
|---|---|---|---|---|
| D. 268,003 | | 2/1983 | Ohno . | |
| D. 279,647 | | 7/1985 | Ohno . | |
| 591,479 | * | 10/1897 | Link | 70/149 |
| 1,991,822 | * | 2/1935 | Snipes | 70/149 |
| 2,019,534 | * | 11/1935 | Henst | 292/DIG. 27 |
| 2,176,297 | * | 10/1939 | Dials | 70/149 |
| 2,185,863 | * | 1/1940 | Miller | 70/149 |
| 2,497,328 | * | 2/1950 | Smith et al. | 70/149 |
| 2,497,329 | * | 2/1950 | Smith et al. | 70/149 |
| 2,529,230 | * | 11/1950 | Smith et al. | 70/149 |
| 2,785,916 | | 3/1957 | Mutti . | |
| 3,159,993 | | 12/1964 | Crepinsek . | |
| 3,193,315 | * | 7/1965 | James | 292/169.21 |
| 3,898,822 | | 8/1975 | Schalm . | |
| 3,948,066 | | 4/1976 | Solovieff . | |
| 4,286,812 | | 9/1981 | Sprekeler . | |
| 4,384,738 | | 5/1983 | Floyd . | |
| 4,536,020 | | 8/1985 | Thomson . | |
| 4,583,382 | | 4/1986 | Hull . | |
| 4,695,082 | | 9/1987 | Marks . | |
| 4,696,174 | | 9/1987 | Marks . | |
| 4,926,664 | | 5/1990 | Gartner et al. . | |
| 5,002,322 | | 3/1991 | Fukumoto . | |
| 5,018,375 | | 5/1991 | Tully . | |
| 5,020,345 | | 6/1991 | Gartner et al. . | |
| 5,027,629 | | 7/1991 | Liu . | |
| 5,083,122 | | 1/1992 | Clark . | |
| 5,421,178 | | 6/1995 | Hamel et al. . | |
| 5,437,174 | | 8/1995 | Aydin . | |
| 5,474,348 | | 12/1995 | Palmer et al. . | |
| 5,513,510 | * | 5/1996 | Solovieff et al. | 70/472 |
| 5,542,274 | | 8/1996 | Thordmark et al. . | |
| 5,715,715 | | 2/1998 | Nunez . | |
| 5,768,926 | * | 6/1998 | Shen | 70/472 |
| 5,890,385 | * | 4/1999 | Lee | 70/472 |
| 5,992,195 | * | 11/1999 | Huang et al. | 70/472 |

FOREIGN PATENT DOCUMENTS

| | | |
|---|---|---|
| 7284 | 1/1898 | (GB) . |

* cited by examiner

*Primary Examiner*—Darnell Boucher
(74) *Attorney, Agent, or Firm*—DeLio & Peterson, LLC

(57) ABSTRACT

A free-wheeling lock mechanism for operating a door latch includes a body, a handle, a lock and a split shaft having two halves rotationally connected together along the shaft axis. One half of the shaft is connected to the handle and one half extends from the body to operate the door latch. The two halves of the shaft may be coupled and uncoupled via a shaft lock movable perpendicular between locked and unlocked positions. In the unlocked position the shaft lock connects the two halves of the shaft to rotate together when the handle is turned. In the locked position the shaft lock disengages the two halves of the shaft to rotate separately and allow the handle to free-wheel without operating the door latch.

25 Claims, 6 Drawing Sheets

LEVER HANDLE CONTROLLER

BACKGROUND OF THE INVENTION

1. Field of the Invention

The present invention relates to locking mechanisms for door locks in which the handle is allowed to "free-wheel", i.e., rotate without retracting the latchbolt, when the mechanism is locked. More particularly, this invention relates to locking mechanisms of the type which are provided with a handle and mounted to the exterior face of a door to operate a latching mechanism mounted inside the door.

2. Description of Related Art

One type of door lock that is widely used in public buildings, businesses, schools and the like includes a latching mechanism (door latch) mounted inside the door and inner and outer handle mechanisms or trim sets which operate the latching mechanism. The latching mechanism includes one or more latches which hold the door to the door frame. The inner and outer handle mechanisms are surface mounted on the inner and outer faces of the door and operate the latching mechanism inside the door.

The latches may be conventional vertical rod latches extending out the top and/or bottom edge of the door, or a single conventional center latch bolt may extend out the edge of the door. Regardless of the particulars of the latching mechanism, however, it will include a central operating point, to which the externally mounted handle mechanisms will attach, commonly through a shaft which rotates to operate the latching mechanism. The central operating point retracts the latch bolt and/or latch rods out of latching engagement with the door frame when a handle on the inner or outer handle mechanism is turned.

The inner and outer handle mechanisms are each provided with a handle which may be rotated to retract the latches and open the door. Each handle mechanism is provided with a spindle or shaft that extends from the handle mechanism through the surface of the door and into the central operating point of the latching mechanism.

In one popular implementation of this basic type of door lock, the outer handle mechanism houses the locking mechanism and includes all the locking components necessary to lock the door, in addition to the handle and basic case in which they are mounted. The function of the locking mechanism in this type of design is to prevent the handle shaft from turning whenever the locking mechanism is locked, and thereby prevent the door from being opened. The outer handle mechanism with its integrated locking functionality may then be attached to any desired type of door latch, and the latching mechanism need not have any means of being locked.

Up to now, in devices of this type the handle has been connected substantially directly to the latching mechanism, most often through a solid shaft, and the locking function has been achieved by physically blocking the motion of the handle, the shaft or components connected thereto. The rotation of the handle or shaft is blocked when the door is locked by turning a key in the locking mechanism. This has been a highly successful design when the handle is a conventional door knob. However, the advent of lever handles has increased the lock requirements greatly and made it very difficult to adequately strengthen internal lock components to withstand the forces that can be applied to prevent a lever handle from being turned. The outer handle and lock mechanism, when provided with a lever handle may be referred to as a lever handle controller, and the present invention generally relates to such devices.

Doors are much easier to open when the handle is shaped as a lever rather than a conventional round door knob. For this reason, lever handles are preferred in some applications, and they may be required under applicable regulations for certain doors in public buildings to facilitate access by the disabled and the elderly.

However, the lever shape of the door handle allows a large force to be applied to the locking mechanism of the door and to the mounting between the door and the locking mechanism. The greater leverage available from a lever handle may allow a vandal or thief to break the internal components of the door lock by standing or jumping on the lever end of the handle.

To address this problem, the present invention has been designed such that the handle on the locking mechanism is disengaged from the shaft extending from the locking mechanism to the latching mechanism. This allows the handle to free-wheel or rotate without operating the latching mechanism and prevents the lever handle from being used to overstress the components of the door lock. Free-wheeling surface mounted lock mechanisms for controlling separate latch mechanisms have not heretofore been available.

Bearing in mind the problems and deficiencies of the prior art, it is therefore an object of the present invention to provide a lock mechanism for operating a door latch which allows the handle to free-wheel when the door is locked.

It is another object of the present invention to provide a free-wheeling lock mechanism in which the connection between the handle and shaft extending to operate the door latch is both rugged and reliable, yet relatively inexpensive, the connection allowing a relatively high level of torque-to be transmitted through to the door latch from the handle when the door is unlocked and yet being disengageable when the door is locked to provide for free-wheeling operation.

Yet another object of the present invention to provide a free-wheeling lock mechanism in which the mechanism shifts positively and completely from the fully locked to the fully unlocked position.

Still other objects and advantages of the invention will in part be obvious and will in part be apparent from the specification.

SUMMARY OF THE INVENTION

The above and other objects, which will be apparent to those skilled in art, are achieved in the present invention which is directed to a free-wheeling lock mechanism for operating a door latch which includes a body, a handle and a shaft mounted in the body. The shaft has first and second halves rotationally connected together along an axis of the shaft with the first half being rotated by the handle and the second half being adapted to operate the door latch. A shaft lock is provided that is movable between unlocked and locked positions to unlock and lock the door. In the unlocked position the shaft lock connects the first half of the shaft to the second half of the shaft so that they rotate together when the handle is turned. In the locked position the shaft lock disengages the first and second halves of the shaft so that they rotate separately and allow the handle to free-wheel.

In the preferred design, the shaft lock slides perpendicular to the axis of the shaft and rotates with one of the halves of the shaft, preferably the half of the shaft that is normally connected to the door latch. In the most highly preferred embodiment, the shaft has a square cross section and the shaft lock includes a lock opening that receives the shaft. In the longitudinal direction of the shaft, the lock opening has two portions—a first portion for receiving the first half of the shaft (the end connected to the handle) and a second portion having a different cross sectional shape for receiving the second half of the shaft (the end connectable to the door latch or latching mechanism that operates the door latch).

The second portion of the lock opening has a rectangular cross section for receiving the end square shaft that connects to the door latch. When the shaft lock moves from the unlocked to the locked position, the shaft moves from a first end of the rectangular cross section to an opposite end of the rectangular cross section, but at both ends the rectangular cross section engages the square cross section of the shaft and prevents it from turning relative to the shaft lock. The first portion of the lock opening (which receives the end of the shaft attached to the handle) also has first and second ends, and these two ends of the first portion of the opening are aligned with the first and second ends of the second portion. The first end of this first portion has a cross sectional shape that prevents the first half of the shaft from rotating relative to the shaft lock. However, the second end of this portion of the lock opening is sufficiently wide to allow the first half of the shaft (connected to the handle) to rotate relative to the shaft lock.

In this way, the sliding motion of the shaft lock perpendicular to the axis of the shaft causes the lock opening to either 1) engage both ends of the shaft to lock them together and prevent them from rotating relative to one another (when the ends are in the corresponding first ends of the lock opening, or 2) disengage the two ends and allow them to rotate relative to one another (i.e., allow the handle to free-wheel) when the ends are in the corresponding second ends of the lock opening.

In another aspect of the invention, the shaft lock includes a body engagement portion, the body engagement portion preventing the shaft lock from rotating relative to the body when the shaft lock is in the locked position. The body engagement portion acts to directly prevent the second half of the shaft from operating the door latch when the mechanism is locked and the handle is free-wheeling and rotating the first half of the shaft.

The shaft lock also preferably includes a handle engagement portion which connects to the handle either directly or indirectly when the mechanism is unlocked. The handle engagement portion provides a good connection between the shaft lock and the handle so that the shaft lock will rotate with the handle when the shaft lock is in the unlocked position and higher torque forces can be transmitted through the shaft while minimizing the loads on the shaft lock. The handle engagement portion is preferably a pair of pins which engage a corresponding pair of slots in a cam attached to the first half of the shaft, near the handle.

In another aspect of the invention, the shaft lock is moved between the locked and unlocked positions by a lock slide which engages the shaft lock and slides relative to the body. A lock cylinder is mounted to the body and includes a tail driven by a key which moves the lock slide. In the most highly preferred embodiment of this aspect of the invention, the lock slide includes a hook and the shaft lock includes an arcuate groove that is engaged by the hook. The curvature of the groove permits the shaft lock to rotate relative to the lock slide while the lock slide and hook remain fixed relative to the body. The lock slide may also include a second hook, with the lock cylinder tail contacting the second hook to move the shaft lock from the locked to the unlocked positions when the cylinder is rotated by the key.

In yet another aspect of the invention, the free-wheeling lock mechanism includes a bistable positioner which acts to move the shaft lock completely on to the other position or back to the original position whenever it is partially offset from either the locked position or the unlocked position. In the embodiment disclosed, the bistable positioner acts on the lock slide which moves the shaft lock.

The bistable positioner preferably comprises a V-projection and a spring member having a V-shape interacting with the V-projection to prevent the lock slide from stopping at intermediate points when moving the shaft lock between the locked and unlocked positions.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjnction with the accompanying drawings in which:

DESCRIPTION OF THE PREFERRED EMBODIMENT

In describing the preferred embodiment of the present invention, reference will be made herein to FIGS. 1–7 of the drawings in which like numerals refer to like features of the invention.

Figure 1:
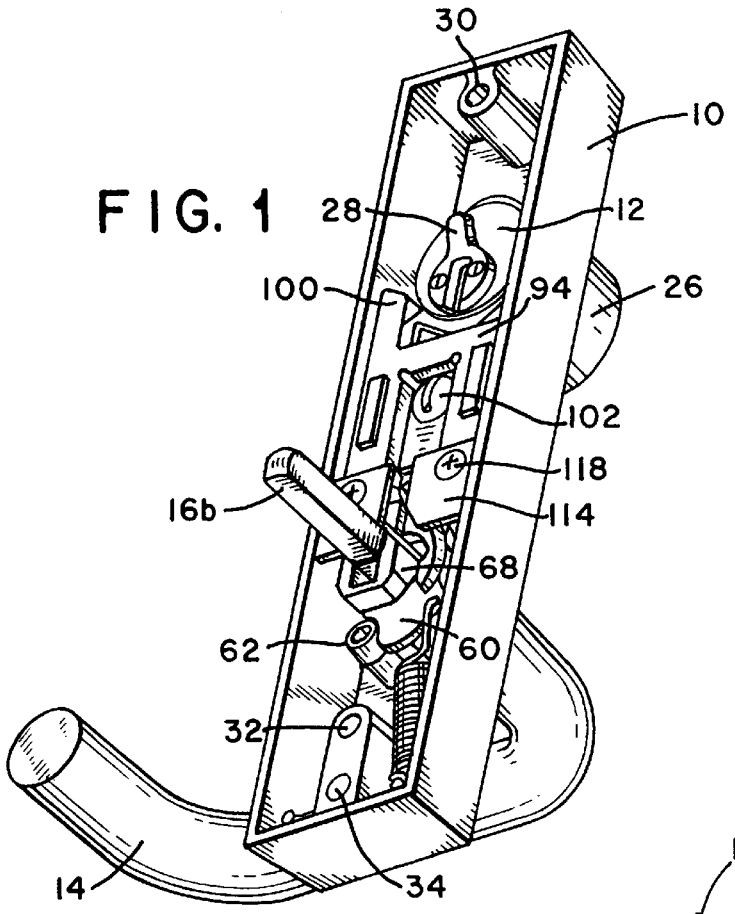
FIG. 1 is a perspective view of the assembled free-wheeling lock mechanism of the present invention taken from a point of view at the right back side of the lock mechanism.
Figure 2:
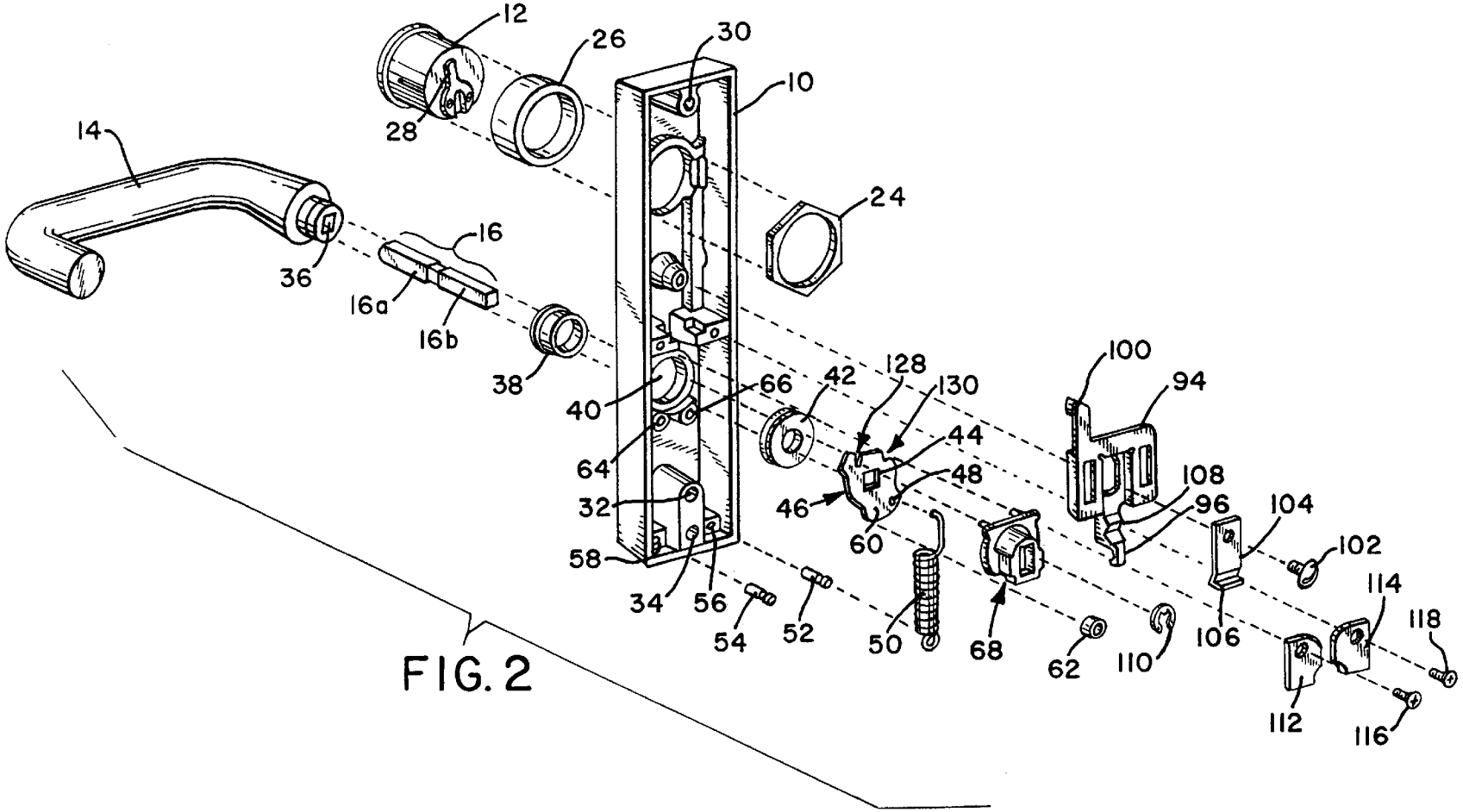
FIG. 2 is an exploded perspective view of the free-wheeling lock mechanism seen in FIG. 1 taken from a point of view at the left back side of the lock mechanism.

Referring to FIGS. 1 and 2, the free-wheeling lock mechanism of the present invention comprises a body 10, a cylinder lock 12, a lever handle 14 and a split shaft 16 including a first half 16*a* for connection to lever handle 14 and a second half 16*b* adapted to connect to and drive any desired type of latching mechanism. Typically the latching mechanism will be mounted inside the door, and will commonly be a vertical rod latching mechanism, however, it may be a conventional center latchbolt, or even a latching mechanism or exit device that is surface mounted to the interior of the door.

Figure 5:
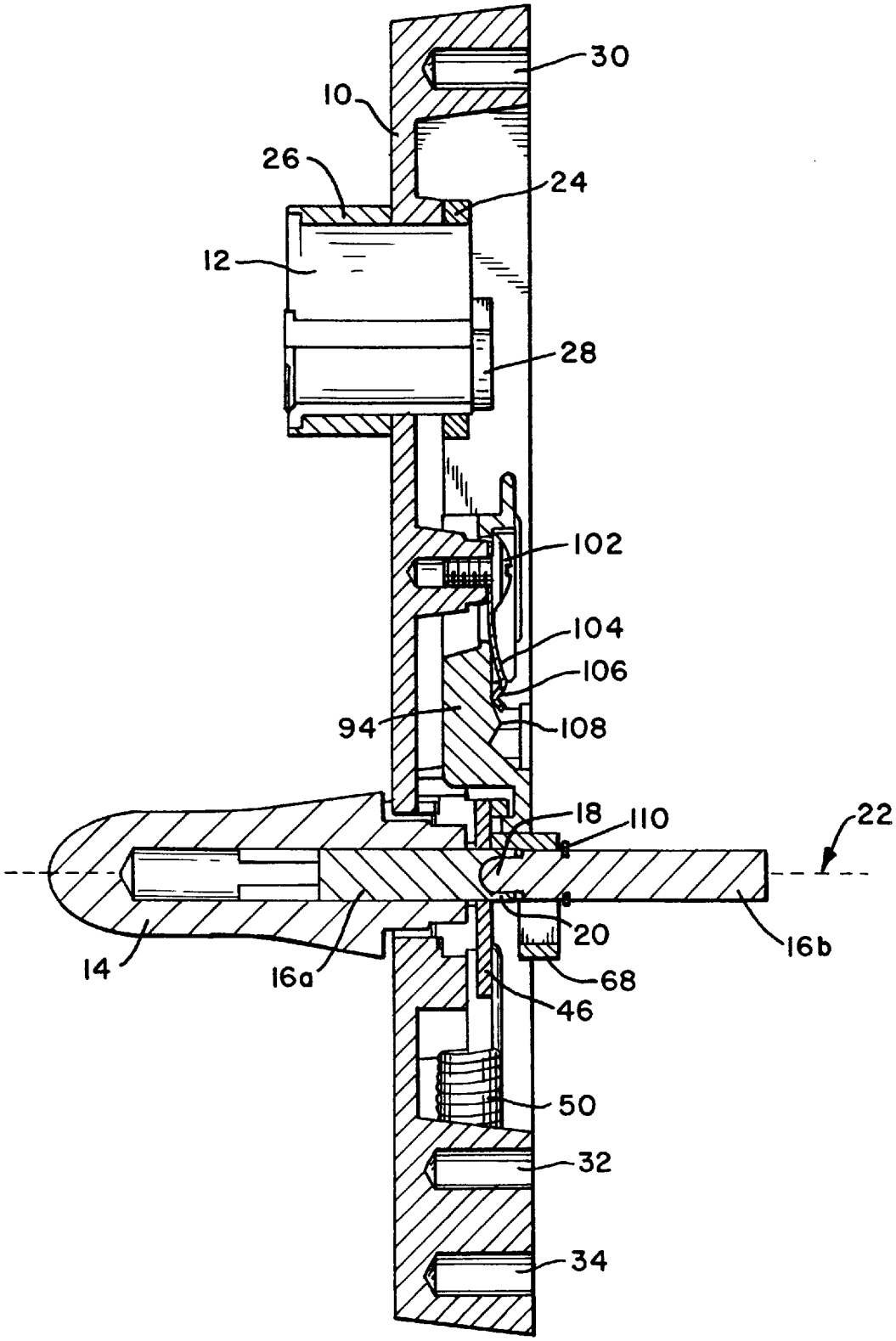
FIG. 5 is a cross sectional view of the free-wheeling lock mechanism of the present invention taken along the line 5—5 in FIG. 4 showing the lock mechanism in the unlocked condition.
Figure 7:
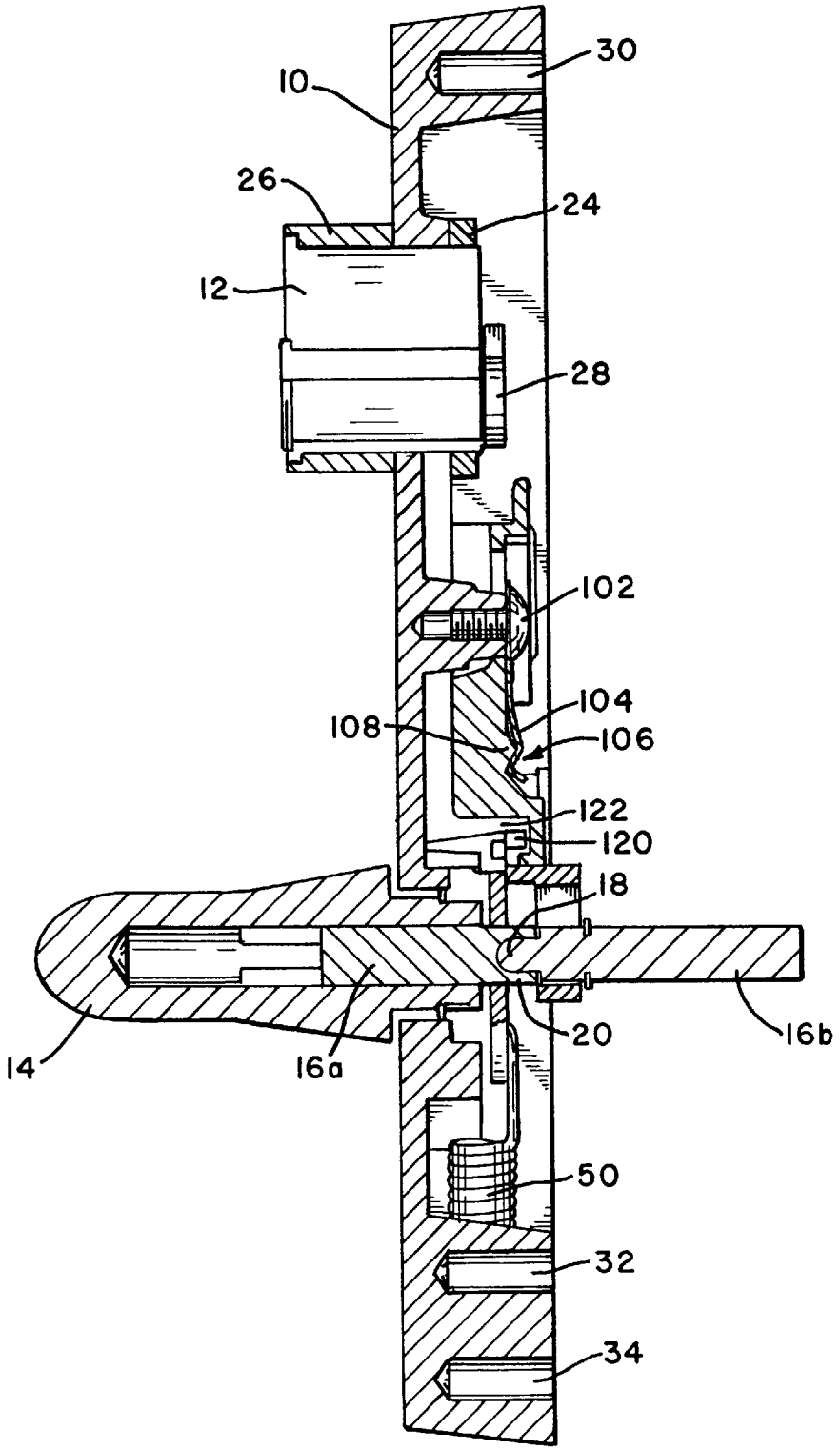
FIG. 7 is a cross sectional view of the free-wheeling lock mechanism of the present invention taken along the line 7—7 in FIG. 6 showing the lock mechanism in the locked condition.

As may be seen in FIGS. 5 and 7, the first half 16*a* and the second half 16*b* of the split shaft 16 are connected together by a ball and socket joint comprising ball 18 and socket joint 20. This joint allows the two halves of the split shaft to rotate independently about their common axis 22. Other methods of producing a split shaft, such as by using an inner shaft of round cross section to coaxially hold the two halves 16*a* and 16*b,* are also suitable.

Referring again to FIGS. 1 and 2 it will be seen that the body 10, in the preferred embodiment, comprises a decorative case which holds the lock cylinder 12 in the case with nut 24. Decorative ring 26 allows the lock cylinder 12 to project forward from the body 10 so that the rear end of lock cylinder 12, which is provided with lock cylinder tail 28 will be inside the body 10 and clear of the door to which the body will be mounted. Lock cylinder tail 28 may be rotated by a key inserted into the lock cylinder 12 from the front.

The body 10 is securely mounted to a door with mounting holes 30, 32 and/or 34.

The split shaft 16 has a square cross section which fits into a square hole 36 in handle 14 such that the first half 16*a* of the split shaft 16 always rotates whenever the handle 14 is turned. The handle 14 is inserted into bushing 38 and then into corresponding opening 40 and is held in position by hub 42. Referring principally to FIG. 2, but also to FIGS. 5 and/or 7, it can be seen that the first half 16*a* of the split shaft 16 extends through the hub 42 and then through square opening 44 in handle cam 46.

Because the square opening 44 in the handle cam directly engages the first half shaft 16*a,* rotation of the handle 14 always rotates handle cam 46. The handle cam 46 includes a small opening 48 which is connected to spring 50, and spring 50 connects via either pin 52 or pin 54 to the body 10 where the pins are inserted into pin holes 56, 58 respectively.

Figure 4:
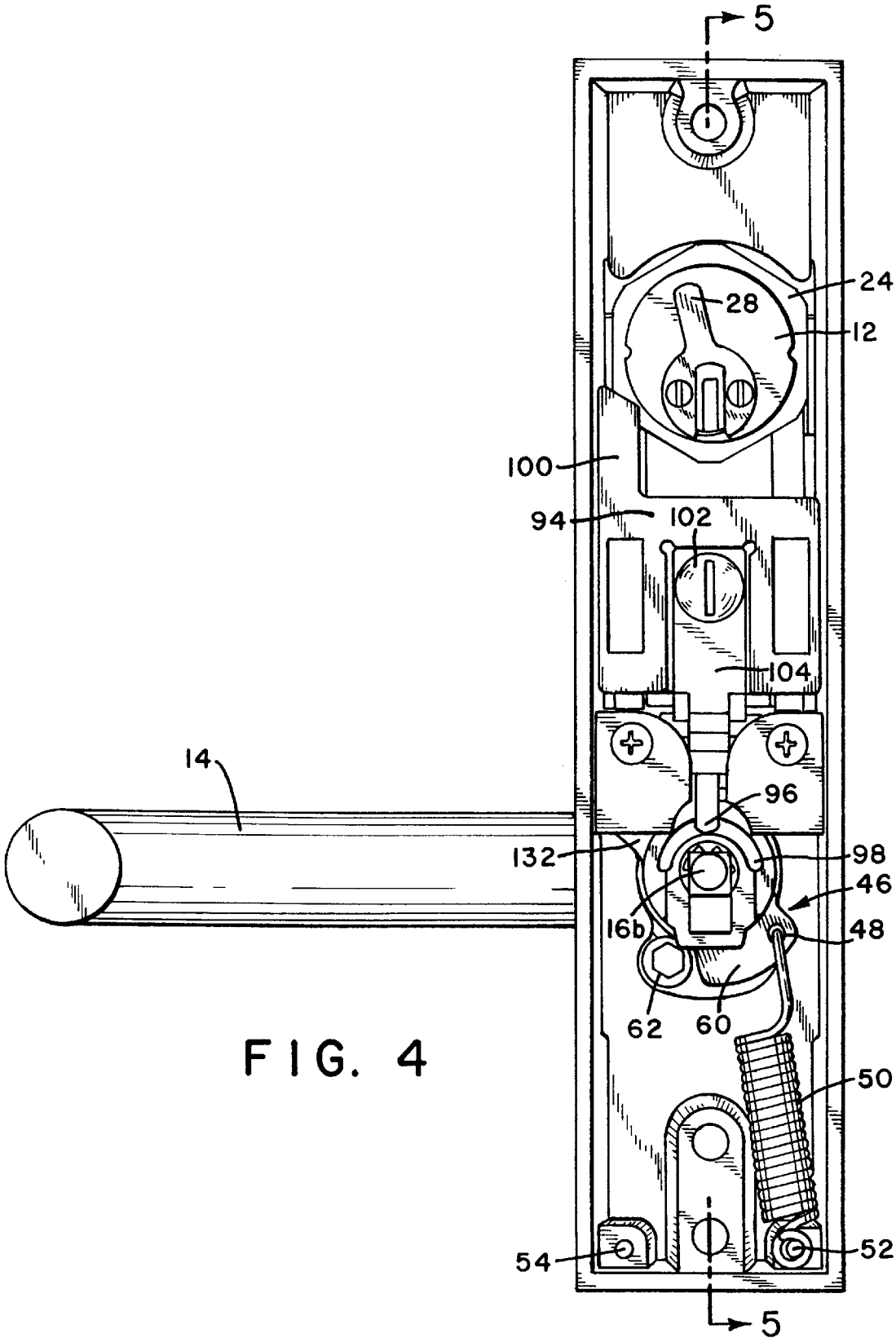
FIG. 4 back elevational view of the free-wheeling lock mechanism of the present invention showing the lock mechanism in the unlocked condition.
Figure 6:
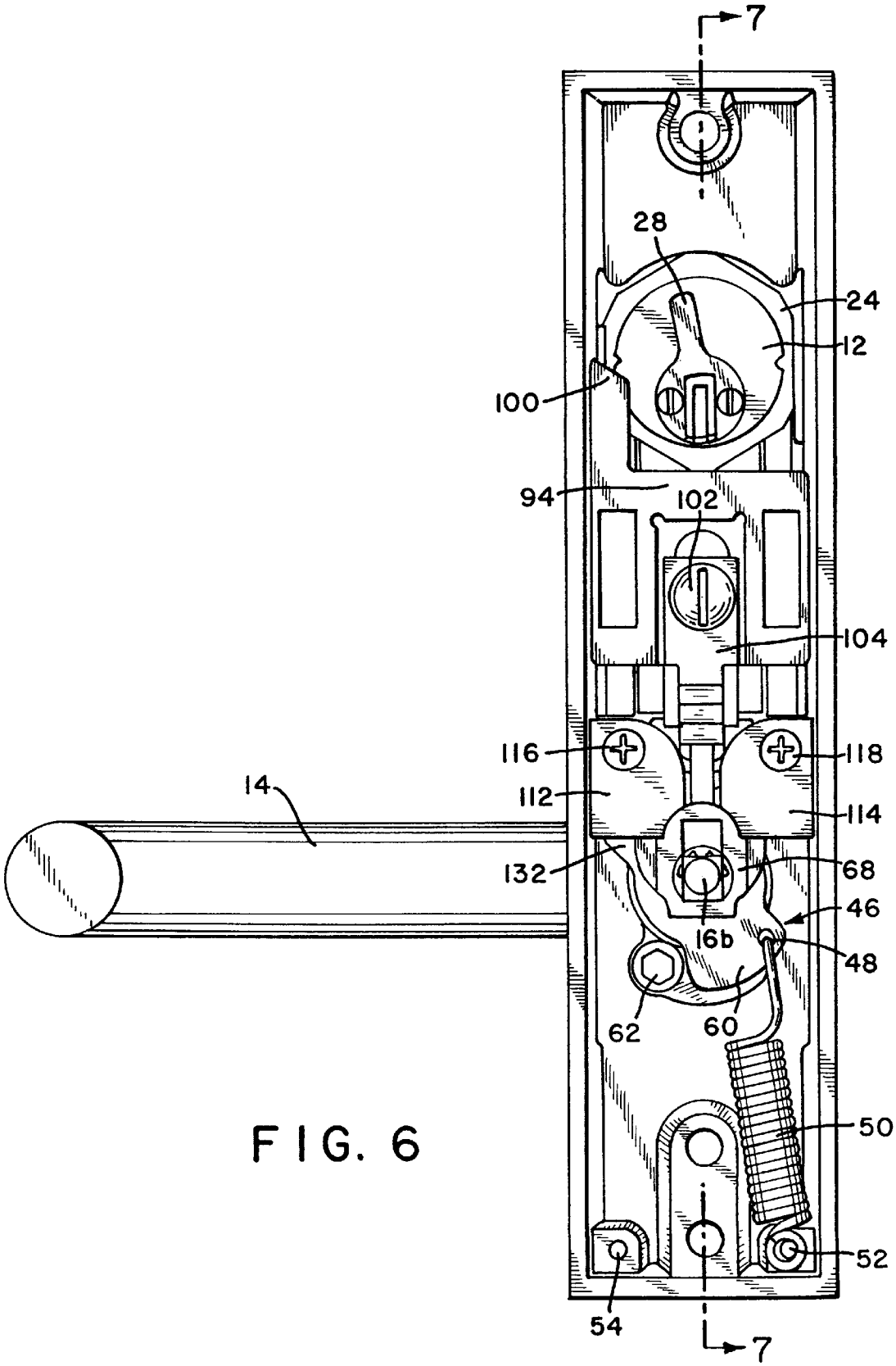
FIG. 6 is a back elevational view of the free-wheeling lock mechanism of the present invention showing the lock mechanism in the locked condition.

As may be seen in FIGS. 1, 4 and 6, a tab 60 on handle cam 44 acts as a stop when it contacts the head of stop screw 62 . As may be seen best in FIGS. 4 and 6, spring 50 pulls down on the handle cam 46 at hole 48 which rotates the handle cam 46 and the first half 16*a* of the split shaft until the tab 60 contacts stop screw 62. This brings the lever handle 14 to the horizontal position. If the lock mechanism needs to be reversed for installation on a door of opposite swing, the handle cam 46 may be slipped off the half shaft and reversed. The spring 50 is then connected to the opposite pin 54, and the stop screw 62 is moved from stop screw hole 64 to stop screw hole 66 (see FIG. 2).

The components of the mechanism which have been described so far, which generally include the lock cylinder, the case, the first half 16*a* of the shaft and the handle, are reasonably conventional. Similar components (with the exception of the split shaft) are found in all lock mechanisms of this general type. The components which remain to be described, however, which provide the connection between the handle and the second half 16*b* of the split shaft are distinctly different from prior art designs. Before describing these components in detail, it can simply be stated that the principal function of these components is to connect the two halves 16*a,* 16*b* of the split shaft 16 so that turning one turns the other when the door is to be unlocked, and to disconnect the two halves and allow them to turn relative to each other when the door is to be locked.

When the two halves of the split shaft are connected together, rotation of the handle 14 will drive a latching mechanism connected to the second half 16*b* of the split shaft. This opens the door. On the other hand, when the two halves of the split shaft are allowed to turn relative to each other, turning the handle will not turn half shaft 16*b* and the handle 14 will free-wheel without operating a latching mechanism connected to half shaft 16*b.*

The particular type of latching mechanism attached to 16*b* is irrelevant to the present invention. It may be desirable to connect the invention to a vertical rod door mechanism located inside a door or a simple latch bolt or exit device or other mechanism may be located either inside the door or on the opposite side of the door from the locking mechanism of this invention.

Further, while the components described below provide the preferred embodiment of the invention, it should be understood that there are many variations upon the present design which are within the skill of those working in this field which will allow the first and second half 16*a* and 16*b* of the split shaft to be connected and disconnected by the device and such variations are to be considered within the scope of the present invention.

Referring now to FIGS. 2 and 3*a*–3*c,* the coupling and uncoupling of the two halves 16*a* and 16*b* of the shaft 16 is principally accomplished by moving the shaft lock 68 perpendicular to the axis 22 of the shaft 16 between locked and unlocked positions. Shaft lock 68 includes a lock opening 70 that is approximately rectangular in shape, having two ends on opposite sides of dividing plane 78 and two portions on opposite sides of dividing plane 72. The shaft 16 extends through the lock opening and the lock opening is large enough in its long dimension to let the shaft lock move perpendicular to the axis 22 of the shaft 16 between the opposite ends.

When the shaft lock moves up (towards the lock cylinder 12) the shape of the opening 70 uncouples the two halves 16*a,* 16*b.* This lets the handle free-wheel and the lock mechanism is locked. When the shaft lock 68 slides down (away from the cylinder lock 12), the shape of the opening 70 holds the two half shafts 16*a,* 16*b* coupled together. When the shaft lock is in this position, rotation of the handle rotates the second half shaft 16*b* and the shaft lock 68, as well as the first half shaft 16*a.* When the shaft lock is in this position, the door is unlocked.

Figure 3A:
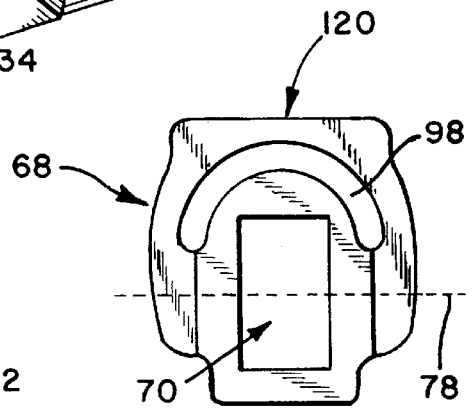
FIG. 3*a* is a back elevational view of the shaft lock component of the free-wheeling lock mechanism of the present invention.
Figure 3B:
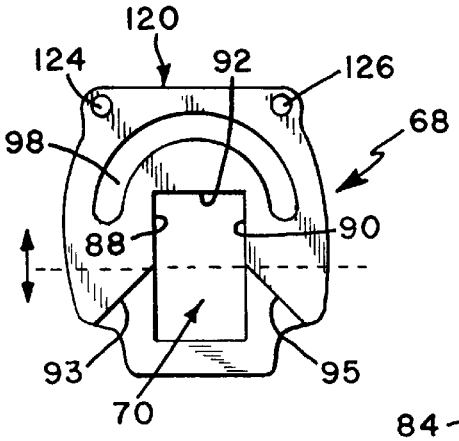
FIG. 3*b* is a front elevational view of the shaft lock component of the free-wheeling mechanism seen in FIG. 3*a*.
Figure 3C:
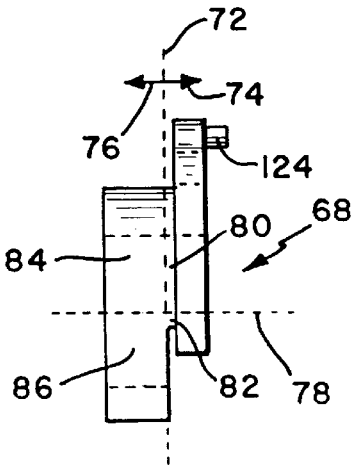
FIG. 3*c* is a left side elevational view of the shaft lock component of the free-wheeling lock mechanism seen in FIG. 3*b*.

Referring to the three views of FIGS. 3*a*–3*c,* the lock opening 70 can be seen in detail. The shaft lock 68 is positioned relative to the shaft 16 such that the joint between the first half shaft 16*a* and second half shaft 16*b* lies exactly in plane 72 of FIG. 3*c.* Plane 72 divides the lock opening 70 into two portions. The first half shaft 16*a* lies on the side of this plane indicated with arrow 74 and the second half shaft 16*b* lies on the side indicated with arrow 76. The half shafts remain on their respective sides of plane 72 regardless of how the shaft lock moves.

In a similar manner, plane 78, which is perpendicular to plane 72, also divides the lock opening in half. Except when the shaft lock 68 is being moved between the locked and unlocked positions, the shaft 16 lies entirely on one side or the other of plane 78. In the locked (free-wheel) position, the shaft 16 is below plane 78. In the unlocked position, the shaft 16 is above plane 78.

Thus, planes 72 and 78 divide the lock opening into four quadrants, 80, 82, 84 and 86, seen best in FIG. 3*c.* Quadrants 84 and 86 hold the second half shaft 16*b* and quadrants 80 and 82 hold the first half of the shaft 16*a.* Motion of the shaft lock from the locked to the unlocked position causes half shaft 16*a* to move from quadrant 82 to 80 and half shaft 16*b* to move from quadrant 86 to 84. It is the shapes of these quadrants of the lock opening which control the relative rotation of the two halves of the shaft 16.

As may been seen best in FIG. 3*a,* the second portion of the lock opening, i.e. the portion containing quadrants 84 and 86 and which receives the second half shaft 16*b,* is exactly rectangular in shape and has a width just sufficient to receive the square shaft 16*b.* The sliding motion of shaft lock 68 from the unlocked position to the locked position moves the second half shaft 16*b* from the top end (quadrant 84) to the bottom end (quadrant 86) of the first portion of the lock opening 70. From this, it will be understood that the shaft lock 68 always turns with the second half shaft 16*b* just as the handle cam 46 always turns with the first half shaft 16*a.*

FIG. 3*b* shows the cross sectional shape of the first portion of the lock opening i.e. the portion on side 74 of plane 72 and the side which receives the first half shaft 16*a.* The upper or first end of this portion (quadrant 80) is approximately square in cross sectional shape having three sides which contact and engage the square cross sectional shape of half shaft 16*a* when the shaft lock 68 is in the unlocked position.

When the mechanism is unlocked, with half shaft 16*a* in quadrant 80, the sides 88, 90 and 92 of quadrant 80 engage the first half shaft 16*a* and prevent the shaft lock from turning relative to the half shaft 16*a*. Because the shaft lock always turns with half shaft 16*b,* this couples the two halves together and unlocks the door.

When the mechanism is locked, with half shaft 16*a* in quadrant 82, however, the first half shaft 16*a* is not engaged by the shaft lock. Quadrant 80 opens outward in a V formed by sides 93 and 95 is wide enough that the half shaft 16*a* can rotate freely within quadrant 82.

The shaft lock 68 is moved between the unlocked position shown in FIGS. 4 and 5 and the locked position shown in FIGS. 6 and 7 by lock slide 94. Lock slide 94 includes a hook 96 which engages an arcuate groove 98 (see FIGS. 3*a*–3*b*). Hook 96 pulls the shaft lock 68 upwards to lock the mechanism (disconnect half shaft 16*a* from half shaft 16*b)* or pushes it downwards to unlock the mechanism (connect half shaft 16*a* to half shaft 16*b*).

When the shaft lock 68 and lock slide 94 are down, the shaft lock 68 rotates when the handle is turned. The arcuate groove 98 allows the necessary relative rotation between the moving shaft lock and the stationary hook 96 and lock slide 94 which remain fixed relative to the body 10. Accordingly, arcuate groove 98 has a center of curvature which is approximately located on the axis of shaft 16 when it is in the upper or first end 80, 84 of the lock opening 70.

The lock slide 94 is moved between the lock and unlocked positions by the lock cylinder tail 28 which contacts a second hook 100 located approximately on the opposite side of the lock slide 94 from the first hook 96. When the key is inserted into the lock cylinder 12 and rotated, tail 28 rotates around. When rotated fully in the counter clockwise direction (as seen from the front of the lock), tail 28 strikes the underside of hook 100. This draws the lock slide upwards, pulling on the shaft lock via the first hook 96 and groove 98, to move the shaft lock such that shaft 16 lies in quadrants 82 and 86 of the lock opening. This locks the mechanism as previously described.

When the key is rotated clockwise the lock cylinder tail 12 rotates until it strikes the upper surface of hook 100 driving the lock slide 94 downwards. This slides the shaft lock down until the shaft extends through quadrants 80 and 84 and the two halves 16*a* and 16*b* become coupled. The mechanism is now unlocked and the handle can turn the second half shaft 16*b* which operates a latch mechanism inside the door.

Lock slide 100 is slidingly held within the body by screw 102 and spring member 104. Spring member 104 includes a V-shaped bend 106 at one end which interacts with a V-shaped projection 108 on lock slide 94. The combination of the V-shaped bend of spring member 104 with the V-shaped projection 108 on the lock slide forms a bi-stable positioner which prevents the lock slide from stopping at intermediate positions between fully locked and fully unlocked.

The spring action of spring member 104 and the sliding ramp interaction of the V-shaped elements forces the lock slide 94 to either return to the original position (if the peak of the V-shaped projection has not passed the peak of the V-shaped bend in the spring member) or to move fully and completely to the opposite position (if the peak of the V-shaped projection has moved past the peak of the V-shaped bend in the spring member).

C ring 110 holds the shaft lock 68 onto the shaft 16. The shaft lock slides perpendicular to the shaft 16 between the C ring 110 and the handle cam 46. Guides 112, 114 are held on the body 10 by screws 116, 118 and help to guide the motion of the shaft lock as it comes to the locked position.

While the shaft lock is sufficiently strong to couple the two shaft halves 16*a,* 16*b* when they are turned by the handle, the preferred embodiment of this invention provides additional features on the shaft lock 68 which improve its performance. First, the upper portion of the shaft lock (as seen in FIGS. 3*a*–3*c*) is substantially flat along surface 120. This flat surface forms a body engagement portion which comes into contact with a stop 122 (see FIG. 7) when the shaft lock 68 slides to the upper locked position. This surface, and its engagement with stop surface 122, prevents the second half shaft 16*b* from rotating when the handle is free-wheeling while the mechanism is locked.

Another feature of the shaft lock acts when the shaft lock slides to the opposite position (unlocked). As illustrated in FIG. 5, a pair of pins 126, 124, which extend outwardly from the shaft lock, engage the handle cam in slot 128 and notch 130, respectively. The engagement between the pins and the slot/notch improves the connection between the handle cam and the shaft lock when the shaft lock is in the unlocked position. First, the pins prevent the shaft lock 68 (which turns with the second half shaft 16*b*) from moving into anything other than the correct aligned position relative to the handle cam (which turns with the first half shaft 16*a*).

Second, the pins improve the torque carrying connection between the shaft lock and the handle cam.

In addition to the horizontal stop action of stop screw 62 with tab 60, stop screw 62 cooperates with stop surface 132 on the handle cam (as seen in FIG. 4). The stop surface 132 on the handle cam contacts stop screw 62 when the handle has rotated to a desired limit of about 60 degrees to prevent excessive rotation of the handle. This protects the hook 96 which is held in arcuate groove 98.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A free-wheeling lock mechanism for operating a door latch comprising:

a body;

a handle;

a shaft mounted in the body, the shaft having first and second halves rotationally connected together along an axis of the shaft, the first half being rotated by the handle and the second half being adapted to operate the door latch; and a shaft lock movable between unlocked and locked positions, in the unlocked position the shaft lock connecting both the first and second halves of the shaft to rotate together when the handle is turned and in the locked position the shaft lock disengaging the first and second halves of the shaft to rotate separately and allow the handle to free-wheel, the shaft lock including a lock opening for receiving the shaft, the lock opening having a first portion for receiving the first half of the shaft and a second portion having a different cross sectional shape for receiving the second half of the shaft.

2. The freewheeling lock mechanism of claim 1 wherein the shaft lock slides perpendicular to the axis of the shaft.

3. The free-wheeling lock mechanism of claim 1 wherein the shaft lock rotates with one of the halves of the shaft.

4. The free-wheeling lock mechanism of claim 3 wherein the shaft lock rotates with the second half of the shaft.

5. The free-wheeling lock mechanism of claim 1 wherein:

the shaft has a square cross section;

the second portion of the lock opening has a rectangular cross section for receiving the second half of the square shaft, the shaft moving from a first end of the rectangular cross section to an opposite end of the rectangular cross section as the shaft lock moves from the unlocked position to the locked position, the rectangular cross section having a width sufficiently narrow to prevent the second half of the shaft from rotating relative to the shaft lock; and the first portion of the lock opening has first and second ends aligned with the first and second ends of the second portion, the first end of the first portion having a cross sectional shape preventing the first half of the shaft from rotating relative to the shaft lock and the second end of the first portion allowing the first half of the shaft to rotate relative to the shaft lock.

6. The free-wheeling lock mechanism of claim 1 wherein the shaft lock includes a body engagement portion, the body engagement portion preventing the shaft lock from rotating relative to the body when the shaft lock is in the locked position.

7. The free-wheeling lock mechanism of claim 1 wherein the shaft lock includes a handle engagement portion, the handle engagement portion providing an improved connection between the first end of the shaft connected to the handle and the shaft lock when the shaft lock is in the unlocked position.

8. The free-wheeling lock mechanism of claim 4 further including a handle cam rotated by the first half of the shaft whenever the handle is rotated, the handle engagement portion of the shaft lock engaging the handle cam when the shaft lock moves to the unlocked position.

9. The freewheeling lock mechanism of claim 8 wherein the handle cam includes at least one slot and the handle engagement portion of the shaft lock includes at least one pin engaging the at least one slot in the handle cam when the shaft lock moves to the unlocked position.

10. The free-wheeling lock mechanism of claim 9 wherein the handle cam includes at least one stop to limit rotational motion of the handle relative to the body.

11. The free-wheeling lock mechanism of claim 9 wherein the handle is a lever handle and wherein the free-wheeling lock mechanism further includes a spring connected to the handle cam to support the lever handle in a horizontal position.

12. The free-wheeling lock mechanism of claim 9 wherein the shaft lock includes a surface in sliding contact with the handle cam.

13. The free-wheeling lock mechanism of claim 12 wherein the shaft lock is positioned between the handle cam and a retainer mounted on the shaft.

14. The free-wheeling lock mechanism of claim 13 wherein the retainer is a C-ring mounted on the second half of the shaft.

15. The free-wheeling lock mechanism of claim 1 further including:

a lock cylinder mounted to the body, the lock cylinder having a tail driven by a key received in the lock cylinder; and a lock slide engaging the shaft lock and sliding relative to the body, the lock slide being driven by the lock cylinder tail to move the shaft lock from the locked to the unlocked positions.

16. The free-wheeling lock mechanism of claim 15 wherein the lock slide includes a hook and the shaft lock includes an arcuate groove, the hook engaging the arcuate groove to permit the shaft lock to rotate relative to the lock slide.

17. The free-wheeling lock mechanism of claim 16 wherein the shaft lock rotates relative to the lock slide when the shaft lock is in the unlocked position and the shaft lock remains fixed relative to the lock slide when the shaft lock is in the locked position.

18. The free-wheeling lock mechanism of claim 16 wherein the arcuate groove has a center of curvature approximately aligned with the axis of the shaft when the shaft lock is in the unlocked position.

19. The free-wheeling lock mechanism of claim 16 wherein the lock slide includes a second hook, the lock cylinder tail contacting the second hook to move the shaft lock from the locked to the unlocked positions.

20. The freewheeling lock mechanism of claim 19 wherein the second hook includes an inside surface and an outside surface, the lock cylinder tail contacting the inside surface of the second hook when rotated in one direction and contacting the outside surface when rotated in an opposite direction.

21. The free-wheeling lock mechanism of claim 19 wherein the first and second hooks are on opposite sides of the lock slide.

22. The free-wheeling lock mechanism of claim 1 further including a bistable positioner, the bistable positioner causing the shaft lock to move completely to the locked or unlocked position when partially offset from the locked or unlocked position.

23. The free-wheeling lock mechanism of claim 22 further including a lock slide engaging the shaft lock and sliding relative to the body to move the shaft lock from the locked to the unlocked positions, the bistable positioner acting on the lock slide.

24. The free-wheeling lock mechanism of claim 23 wherein the bistable positioner comprises a V-projection and a spring member having a V-shape interacting with the V-projection to prevent the lock slide from stopping at intermediate points when moving the shaft lock between the locked and unlocked positions.

25. The free-wheeling lock mechanism of claim 24 wherein the V-projection is formed on the lock slide and the spring member is mounted to the body.

* * * * *

UNITED STATES PATENT AND TRADEMARK OFFICE

CERTIFICATE OF CORRECTION

PATENT NO. : 6,178,794 B1
DATED : January 30, 2001
INVENTOR(S) : Darren C. Eller et al.

It is certified that error appears in the above-identified patent and that said Letters Patent is hereby corrected as shown below:

Column 2, line 32, after "torque" delete "--".

Column 3, line 7, after "end" insert --of the--.

Column 3, line 29, after "opening" insert --)--.

Column 4, line 38, after "4" insert --is a --.

IN THE CLAIMS

Column 9, line 19, claim 2, delete "freewheeling" and substitute therefor -- free-wheeling --.

Column 9, line 58, claim 9, delete "freewheeling" and substitute therefor -- free-wheeling --.

Signed and Sealed this

Fifth Day of June, 2001

Nicholas P. Godici

NICHOLAS P. GODICI

*Acting Director of the United States Patent and Trademark Office*

*Attest:*

*Attesting Officer*

UNITED STATES PATENT AND TRADEMARK OFFICE

CERTIFICATE OF CORRECTION

PATENT NO. : 6,178,794 B1
DATED : January 30, 2001
INVENTOR(S) : Darren C. Eller et al.

It is certified that error appears in the above-identified patent and that said Letters Patent is hereby corrected as shown below:

Column 10:
Line 40, delete "freewheeling" and substitute therefor --free-wheeling--.

Signed and Sealed this

Twenty-fourth Day of July, 2001

Nicholas P. Godici

*Attest:*

*Attesting Officer*

NICHOLAS P. GODICI
*Acting Director of the United States Patent and Trademark Office*